US006776151B2

(12) United States Patent
Wiersma et al.

(10) Patent No.: US 6,776,151 B2
(45) Date of Patent: Aug. 17, 2004

(54) POSITIVE AIR FLOW APPARATUS FOR INFRARED GAS BROILER

(75) Inventors: Wouter J. Wiersma, Arcadia, CA (US); Duc Boi Tang, El Mone, CA (US); Gary Gengxin Feng, Covina, CA (US)

(73) Assignee: Distinctive Appliances, Inc.

( * ) Notice: Subject to any disclaimer, the term of this patent is extended or adjusted under 35 U.S.C. 154(b) by 6 days.

(21) Appl. No.: 09/934,782

(22) Filed: Aug. 21, 2001

(65) Prior Publication Data

US 2003/0037780 A1 Feb. 27, 2003

(51) Int. Cl.[7] ..... F24C 15/32; A21B 1/00
(52) U.S. Cl. ..... 126/21 A; 126/273 R
(58) Field of Search ..... 126/21 R, 21 A, 126/39 R, 39 E, 39 K, 273 R, 273.5; 219/400

(56) References Cited

U.S. PATENT DOCUMENTS 3,384,068 A * 5/1968 Perry et al. ..... 126/21 A
3,682,156 A * 8/1972 Perl ..... 126/21 A
3,782,360 A * 1/1974 Brucken ..... 126/273 R
4,375,213 A * 3/1983 Kemp et al. ..... 126/21 A
4,598,691 A * 7/1986 Herrelko et al. ..... 126/41 R
4,846,143 A * 7/1989 Csadenyi ..... 126/39 E
5,909,533 A * 6/1999 Kitabayashi et al. ..... 392/310
6,371,104 B1 * 4/2002 Voohris ..... 126/21 A

FOREIGN PATENT DOCUMENTS

JP 2000-28142 A * 1/2000 ..... F24C/1/00
JP 2002-159402 A * 6/2002 ..... A47J/37/06

* cited by examiner

*Primary Examiner*—Josiah Cocks

(57) ABSTRACT

A kitchen oven has an infrared gas broiler with a venturi tube assembly extending forwardly from a back wall of the oven for supplying fuel gas and drawing ambient air for combustion through a venturi tube opening at the oven back wall. Ducting is mounted on the oven back wall and extends over the venturi tube opening. A fan is mounted on the oven in communication with the ducting for supplying a positive air flow through the ducting to said venturi tube opening.

14 Claims, 6 Drawing Sheets

POSITIVE AIR FLOW APPARATUS FOR INFRARED GAS BROILER

This invention relates to a kitchen cooking oven and, in particular, an oven having an infrared gas broiler with a venturi tube for supplying the fuel gas and drawing atmospheric combustion air through the venturi tube.

Conventional kitchen ovens, domestic or commercial, that are used for cooking food often have plural modes of operation, including broiling, baking, warming, self-cleaning and the like, and such ovens commonly use either gas or electricity but not both until recently. Electric ovens have certain well known advantages over gas ovens, such as being substantially completely sealed to retain all of the heat for efficiency, whereas gas ovens must have fresh air inlets for both primary combustion air and secondary air, as well as a vent for discharging the combusted gases. Conversely, gas ovens have certain well known advantages over electric ovens, such as more even heat for broiling. In particular, infrared gas broilers provide extremely uniform and high temperature broiling heat that is not possible with electric heating element broilers that normally have a limited number of heating element rods spaced a significant distance apart that produce uneven heating.

However, the desirable high heat produced by an infrared gas broiler system located in the ceiling of an oven also creates certain potential problems that may occur under unusual circumstances or use of the oven. One such potential problem is a so-called "flame roll-out" after opening, closing and reopening the oven door within a very short time frame whereupon a portion of the layer of burning gas escapes through the top portion of the open door as insufficiently combusted gas. Another such potential problem is a so-called "flash-back" of the flame in the venturi tube (that supplies the fuel gas and draws atmospheric combustion air into the tube) when the tube becomes very hot and insufficient air is being drawn in for complete combustion. These potential problems are less likely to occur in an all-gas oven because of the conventional secondary air inlets at the bottom of the oven but to add such inlets to an electric oven to accommodate the infrared gas broiler would reduce the efficiency of the electric operation of the oven.

Accordingly, it is a principle object of the present invention to provide a positive air flow apparatus to an infrared gas broiler in an oven to stabilize and improve the operation of the infrared gas broiler. A further object of this invention is to provide such a positive air flow apparatus in which ducting is mounted on a back wall of the oven and extends over the air supply opening of the venturi tube of the infrared gas broiler, and a fan is provided for supplying a positive air flow through the ducting to the venturi tube. A still further object of this invention is to provide such a positive air flow apparatus in which the fan draws the air from over the top of the exterior of the oven for reducing the temperature above the oven. Still another object of this invention is to provide such a positive air flow apparatus in which the ducting includes openings near the venturi tube for allowing air to enter the venturi tube other than the air supplied by the fan.

Other and more detailed objects and advantages of the present invention will appear from the following description and the accompanying drawings, wherein.

Figure 1:
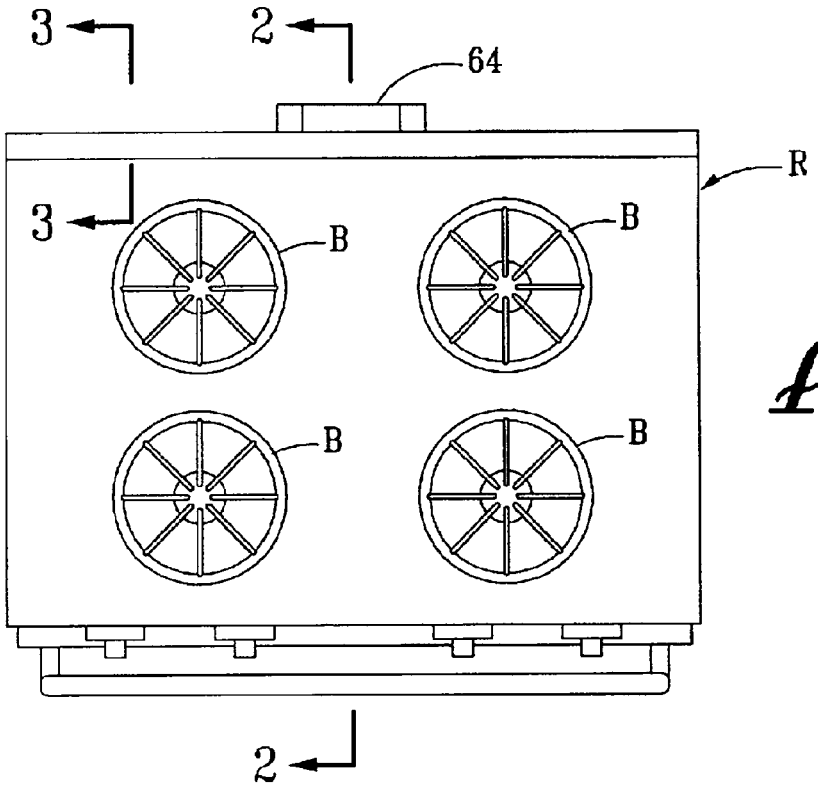
FIG. 1 is a top plan view of a typical kitchen range having four gas cooktop burners and an infrared gas broiler in an oven (not visible) with the positive air flow apparatus (also not visible) of the present invention.

Referring now to the embodiment of the present invention illustrated in FIGS. 1–7, a typical kitchen range R is illustrated as having four cooktop gas burners B, although more or fewer burners may be provided and the burners may be of an electric element type, all of which is conventional. The range R is provided with a single oven although a wider kitchen range R may be provided with a pair of identical or different ovens, as is well known. As will appear more fully below, the oven 10 will be described as an all-gas convection oven having a gas burner for baking and a fan for circulating air within the oven but the present invention is equally applicable to an oven 10 with an electric heating element for baking and without a convection fan. A dual fuel oven having an electric heating element for baking and high temperature cleaning with an infrared gas broiler to which the present invention is applicable is disclosed in U.S. Pat. No. 5,909,533 "Electric Cooking Oven With Infrared Gas Broiler", assigned to the Assignee hereof, and the disclosure of such patent is incorporated herein by this reference as though set forth in full.

Oven 10 of kitchen range R is shown diagrammatically as an oven cell with six insulated and closed sides, namely, a top wall 12, a bottom wall 14, a right side wall 16, a left side wall 18, a rear wall 20 and a front wall 22 with a conventional door 24. A gas burner 26 is provided in the bottom of the oven 10 in a conventional manner but, as noted above, in the alternative the oven 10 may be provided with an electric heating element. The interior or each side wall 16 and 18 is provided with a conventional grate rack 28 for supporting a rod type grate 30 at any desired level within the oven for in turn supporting a pan 32 or the like for supporting the food to be cooked.

An infrared gas broiler, generally designated 34, is provided on the upper interior surface of the oven 10 and attached to the top wall 12. Gas broiler 34 is preferably of the infrared burner type having ceramic radiants 36, three of which are shown for this size oven, that are thin ceramic tile-like elements with a multiplicity of small holes 38 extending vertically therethrough, which holes allow a mixture of fuel gas and air to pass downwardly through the ceramic radiants 36 and burn along the bottom surface of the radiants 36. The gas/air combustion extends over substantially the entire lower surface of the ceramic radiants 36 to thereby heat the ceramic radiants to temperatures of about 1600° F. In turn, the heated ceramic radiants create infrared light waves that peak at a wavelength of about 2.8 microns and radiate downwardly in all directions from the ceramic radiants 36 to evenly heat and broil food items placed in the oven pan 32. The combustion of the fuel gas/air mixture along the bottom surface of the ceramic radiants 36 is very even and continuous during broiling and therefore the intensity of the broiling action on the food primarily is adjusted by selecting the distance of the food from the ceramic radiants 36, such as by using different levels of support for the grate 30 on the grate racks 28. Also, excessive temperatures of the ceramic radiants 36 may be avoided by off and on cycling of the gas supply.

Figure 5:
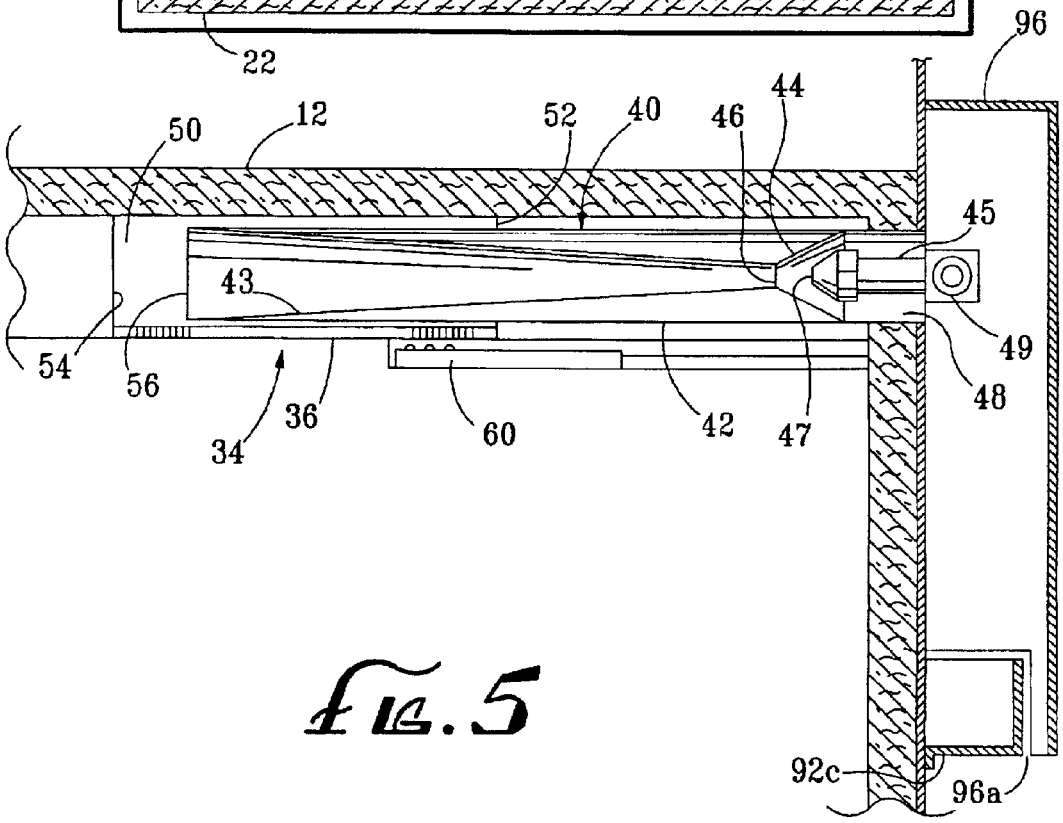
FIG. 5 is an enlarged, fragmentary sectional elevation view taken substantially on the line 5—5 in FIG. 4.
Figure 8:
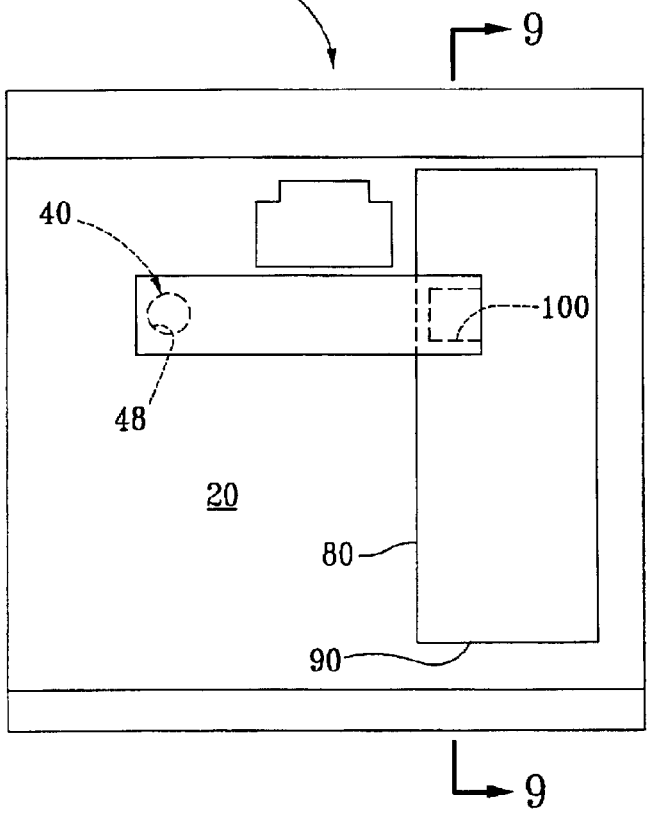
FIG. 8 is an elevation view of the back of a kitchen range similar to FIG. 6 but illustrating another embodiment of the present invention.
Figure 9:
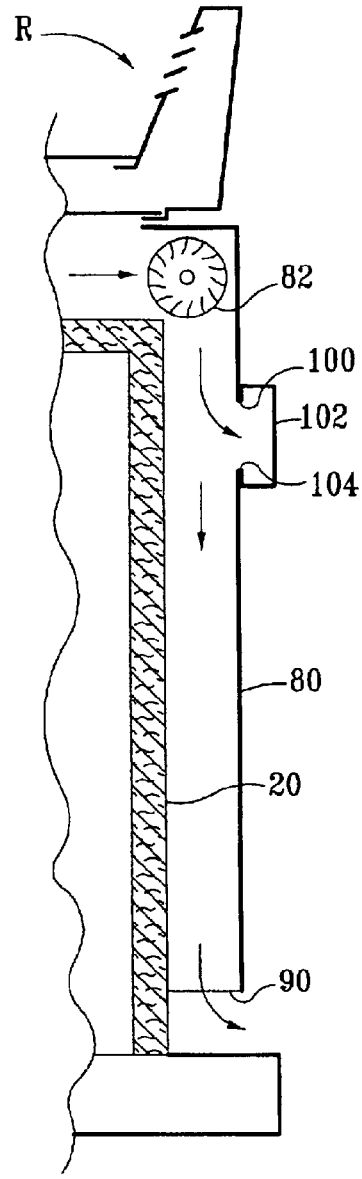
FIG. 9 is a fragmentary, enlarged elevation view taken substantially on the line 9—9 of FIG. 8.
Figures 10, 11, 12, 13:
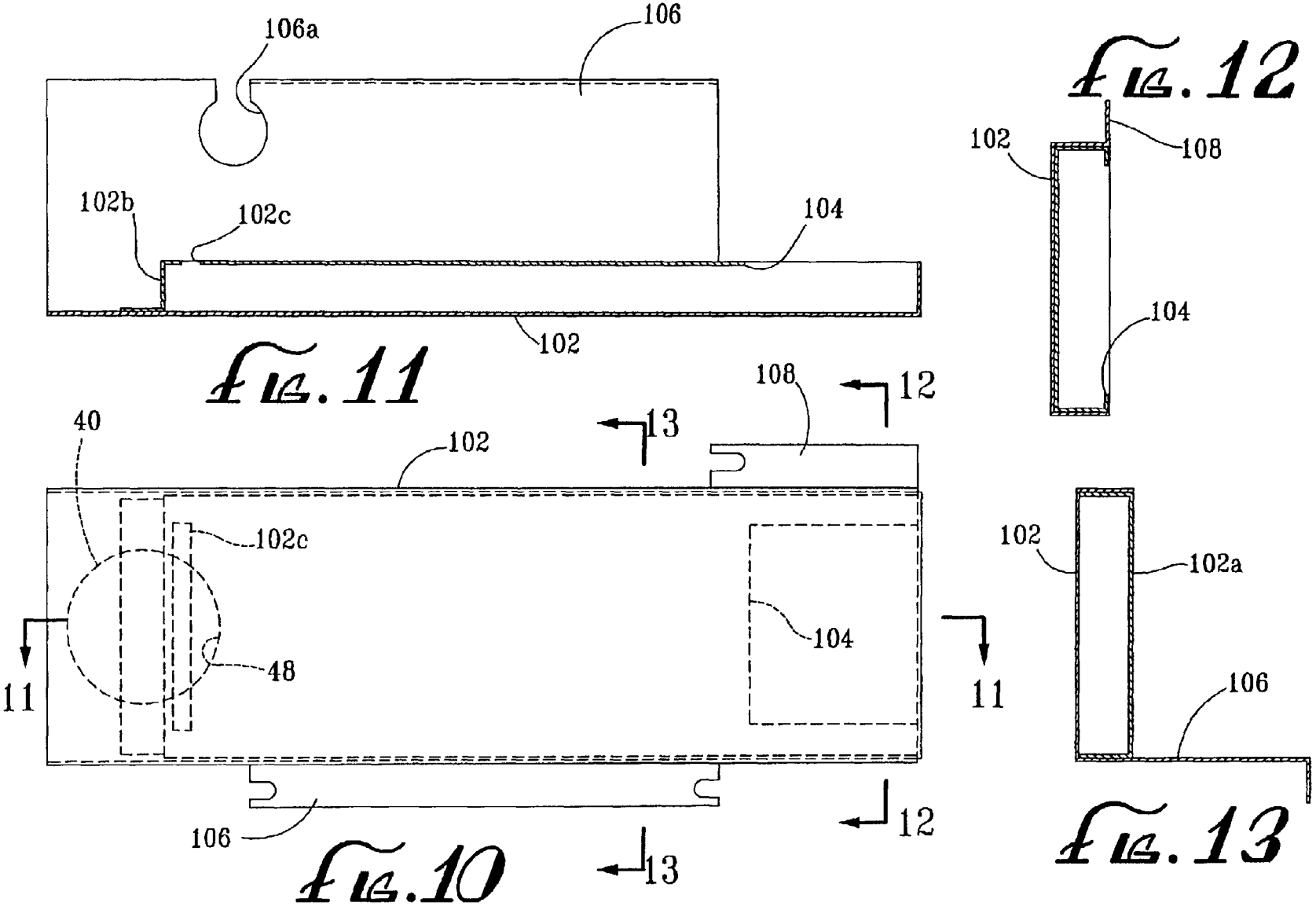
FIG. 10 is a rear elevation view of the air duct of the embodiment of FIGS. 8 and 9.
FIG. 11 is a sectional plan view of the air duct taken substantially on the line 11—11 of FIG. 10.
FIG. 12 is a sectional elevation view of the air duct taken substantially on the line 12—12 of FIG. 10.
FIG. 13 is a sectional elevation view of the air duct taken substantially on the line 13—13 in FIG. 10.

The infrared gas broiler 34 includes a venturi tube assembly, generally designated 40, comprised of a cylindrical outer tube 42, a long frustoconical tube 43, a short frustoconical tube 44 and a gas jet fitting 45 (see FIG. 5). The long frustoconical tube 43 and the short frustoconical tube 44 are joined at their smaller, open ends to form a venturi opening or orifice 46 through which the fuel gas is discharged from the gas jet fitting 45 by a jet opening 47 to thereby draw primary air into the venturi tube assembly 40 through the rear opening 48 in the cylindrical venturi tube 42 and rear wall 20. The venturi tube assembly 40 is of a substantial length and the long frustoconical tube 43 preferably has a very small angle of inclination of its sides, such as about two degrees. By this arrangement, a substantially stoichiometric mixture of fuel gas and air normally is created in the long frustoconical tube 43, which mixture will then burn completely and efficiently in the combustion that occurs on the lower surface of the ceramic radiants 36 during all normal operating conditions of the infrared gas broiler 34. The fuel gas may be natural gas, propane or any other appropriate gas at an appropriate pressure for producing the desired gas/air mixture and flow in the gas broiler 34. The fuel gas is supplied through a line 49 in a conventional manner.

Figure 2:
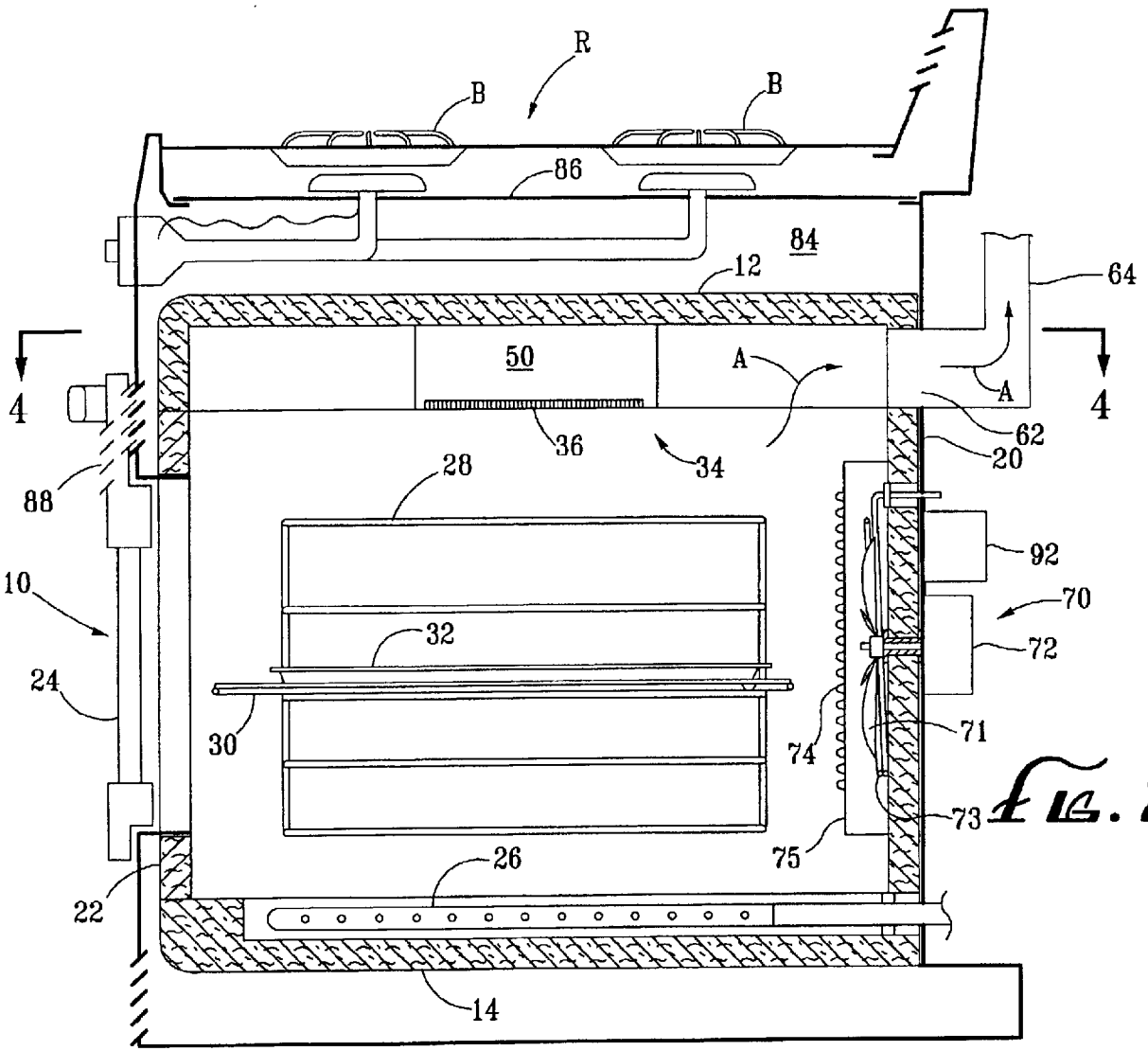
FIG. 2 is a sectional elevation view taken substantially on the line 2—2 in FIG. 1 and illustrating the oven with the infrared gas broiler.
Figure 3:
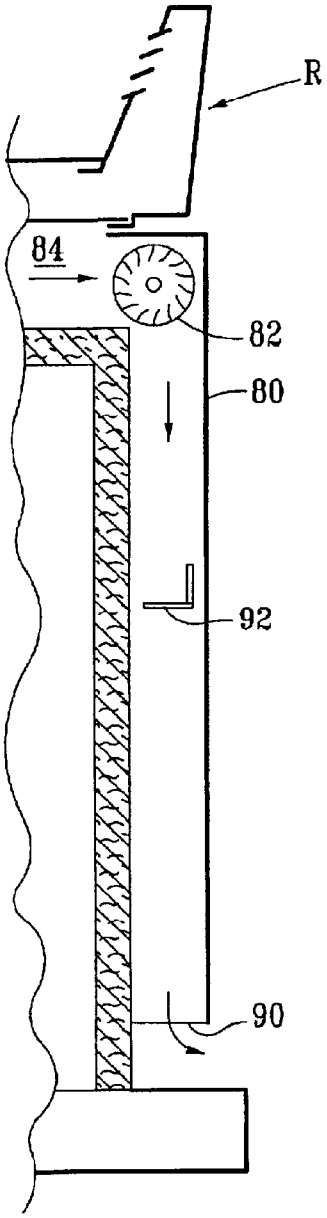
FIG. 3 is a fragmentary sectional elevation taken on the line 3—3 of FIG. 1.
Figure 4:
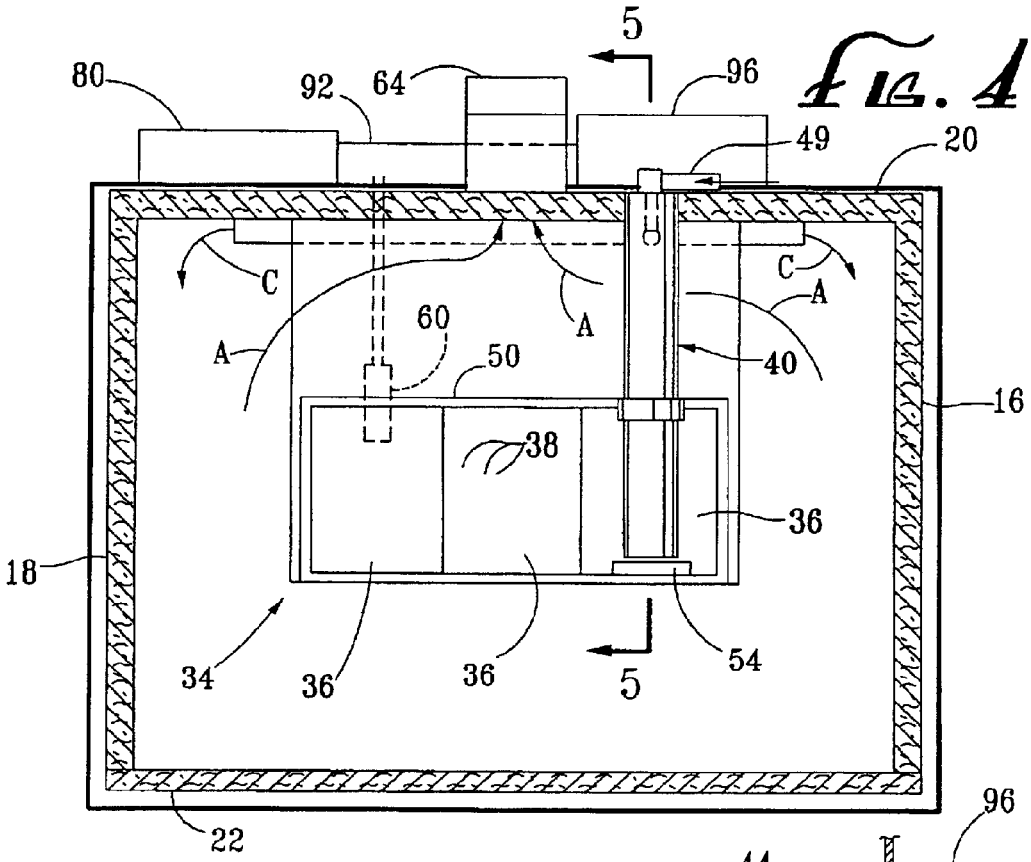
FIG. 4 is a sectional plan view taken substantially on the line 4—4 of FIG. 2.

The infrared gas broiler 34 includes a plenum 50 comprised of a box formed above and around the ceramic radiants 36, which box also supports the ceramic radiants 36 (also see FIGS. 2 and 4). The venturi tube assembly 40 extends into the plenum 50 and the outer cylindrical tube 42 is in a sealed relationship with an opening 52 in the box forming the plenum 50. An L-shaped baffle 54 is provided at and spaced from the discharge end 56 of the venturi tube assembly 40 for more evenly distributing the gas/air mixture into the plenum 50. Additional baffles may be provided in plenum 50 at appropriate locations for enhancing the even distribution of the gas/air mixture to all of the holes 38 in the ceramic radiants 36. By the jet of fuel gas from the gas jet fitting 45, the venturi tube assembly 40 creates a positive pressure in plenum 50 under normal conditions that is higher than the atmospheric pressure, thereby forcing the gas/air mixture through the holes 38 in the ceramic radiants 36 in a substantially even manner which produces a substantially even sheet of flame along the bottom surface of the ceramic radiants 36. The perimeters of the ceramic radiants are sealed to each other and the box plenum 50 by gaskets, such as ceramic fiber gaskets, for assuring that the gas/air mixture flows only through the holes 38 in a controlled manner.

An igniter 60 is provided immediately below one of the ceramic radiants 36 for igniting the gas/air mixture. Preferably, the igniter 60 is a hot surface type igniter having an electrical resistance wire positioned close to the bottom surface of the ceramic radiant 36, although other types of igniters may be used, such as a spark igniter. The resistance wire of igniter 60 is maintained in a red hot condition continually while the gas broiler 34 is in operation to assure that the gas/air mixture is continually ignited or reignited if the flame is inadvertently extinguished. As shown in FIG. 4, it is preferable that the igniter 60 be spaced laterally from the venturi tube assembly 40 to avoid unduly heating the venturi tube assembly.

Before describing the positive air flow apparatus of the present invention for use with the infrared gas broiler 34 and the advantages thereof, the basic operation of the oven 10 will now be described. The gas burner 26 (or alternatively an electric heating element) and the infrared gas broiler 34 are provided with separate controls (not shown) of a conventional type such that when the gas burner 26 is operated for baking or self-cleaning (such as by an electric heating element), the infrared gas broiler 34 is shut-off and conversely when the gas broiler 34 is activated, the oven burner 26 is off. A conventional temperature control is provided in connection with the burner 26 for controlling the temperature of the entire oven to the desired level during baking or warming. A temperature control may also be provided with the infrared gas broiler 34 to prevent an excessively high temperature in the oven, such as by on/off cycling of the broiler, but normally the broiling mode will be continued at the highest temperature that the gas broiler 34 can produce until broiling of the food item is completed. When the broiling mode of operation of oven 10 is desired and the controls are appropriately set, the fuel gas from line 49 will be discharged through the opening 47 of gas jet fitting 45 into the orifice 46 in the venturi tube assembly 40 to draw in fresh air through the open end 48 of the tube 42 that extends through the rear wall 20. The gas/air mixture formed at the orifice 46 is discharged through frustoconical tube 43 and end 56 of the venturi tube assembly 40 into the plenum 50 which normally creates a positive pressure to force the gas/air mixture evenly through all of the holes 38 in the ceramic radiants 36. The control for initiating the operation of the gas broiler 34 also energizes the igniter 60 for igniting the gas/air mixture being discharged downwardly through the holes 38 in ceramic radiants 36, whereby the combustion raises the temperature of the ceramic radiants to about 1600° F. for producing infrared light rays for broiling. The discharge of the gas/air mixture through the holes 38 and the combustion of that mixture creates a positive pressure in the interior of the oven 10 that is higher than the exterior atmospheric pressure. As a result, the combusted gases and heated air from within the oven rise to the top and pass through an opening 62 in the top portion of the rear wall 20 into a vent pipe or flue duct 64 to the outside, as shown by arrows A in FIGS. 2 and 4. The aforedescribed structure and operation of the infrared gas broiler 34 is essentially as disclosed in U.S. Pat. No. 5,909,533 assigned to the Assignee hereof and the present invention is directed to an improvement usable therewith.

While the infrared gas broiler 34 normally operates in an efficient and uninterrupted manner, some unusual circumstances potentially may cause problems such as the aforedescribed "flash-back" and "flame roll-out" that produce abnormal operation of the broiler. Although flash-back and flame roll-out are substantially different occurrences caused by substantially different factors, i.e. flash-back caused by overheating of the venturi tube assembly and flame roll-out being caused by an unusual cycle of opening and closing the oven door 24, the present inventors have discovered and developed a single solution to these divergent problems. Specifically, by this invention a positive air flow is created in the venturi tube assembly 40 at all times that the infrared gas broiler is in operation but without transforming the oven into a pressurized combustion chamber, which would be inappropriate for a commercial or domestic kitchen oven that must be opened and closed for observing and controlling the broiling of the food products. Two specific embodiments of the present invention will be described but it will readily appear to those skilled in the art that other structures and arrangements of the components will be appropriate for practicing the invention.

Referring now specifically to FIGS. 2–7, the cooking range R is provided with a vertically extending duct 80 mounted on the rear wall 20 of the range R with a blower or fan 82 mounted at the upper end of duct 80. The fan 82 draws air through a space 84 between the top wall 12 of the oven and a pan 86 on top of the range R below the burners B from vent openings 88 in the front of the range R. The air is discharged from the bottom 90 of duct 80 and this type of arrangement is relatively conventional for premium kitchen ranges for minimizing the temperature on the top of the range, such as at pan 86, particularly during self-cleaning operation of the oven which is done at very high temperatures.

Figure 6:
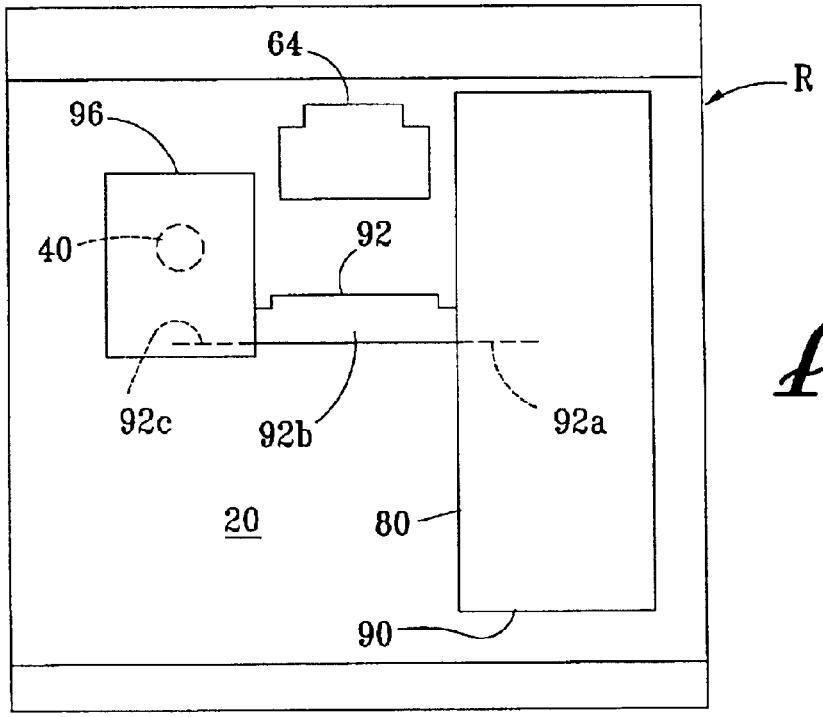
FIG. 6 is an elevation view of the back of the kitchen range illustrated in FIG. 1.
Figure 7:
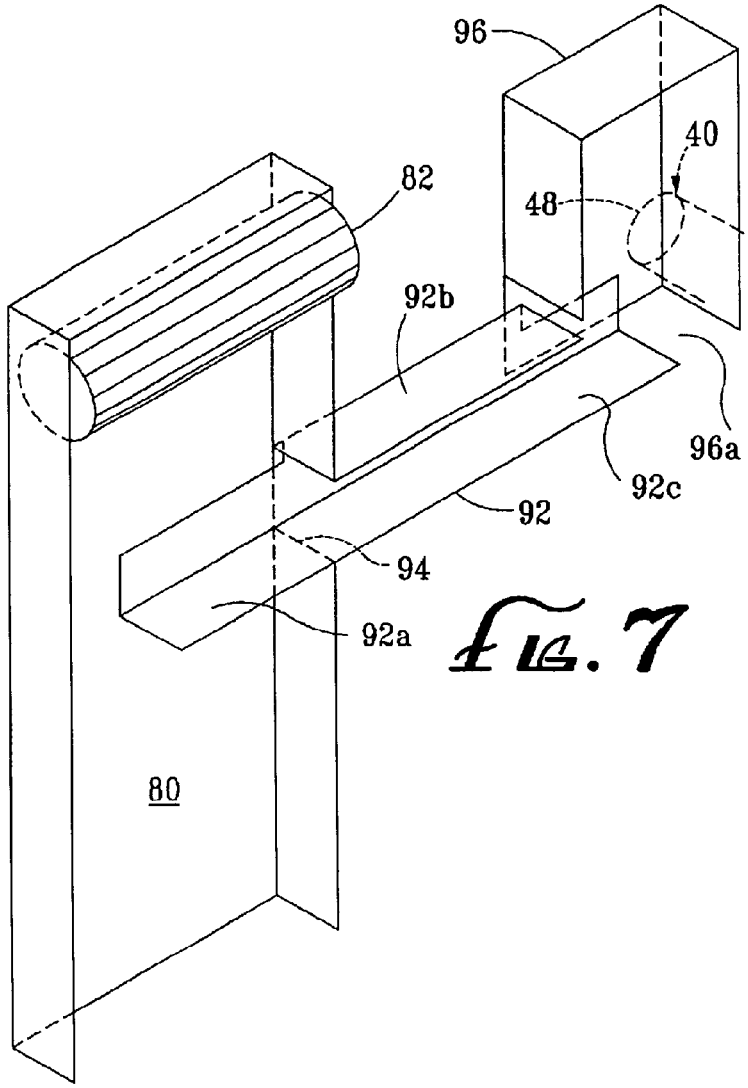
FIG. 7 is a diagrammatic perspective view of the air fan and ducting mounted on the back of the kitchen range shown in FIG. 6 as would be viewed from the above left front of the kitchen range with the kitchen range omitted.

A transfer duct 92 is mounted on the back wall 20 of the range R to extend laterally through an opening 94 in the duct 80. The transfer duct 92 has an L-shaped portion 92*a* extending only part of the distance across the duct 80 and facing upwardly to deflect some of the air being discharged downwardly by the fan 82 into the duct 92 in the lateral direction but still allowing a substantial proportion of the air to continue downwardly through the duct 80 and out the bottom opening 90. The mid-section 92*b* of transfer duct 92 is U-shaped with the open side facing and engaging the back wall 20 to form a box shaped duct that extends laterally along the back wall 20 of range R. The transfer duct 92 then extends into a duct enclosure 96 with another L-shaped portion 92*c* extending across a portion of the duct enclosure 96. The duct enclosure 96 is mounted on the back wall 20 of the range R over the location of the venturi tube assembly 40 in communication with the opening 48 at the rear of the venturi tube assembly. The bottom of duct enclosure 96 is open at 96*a* to allow ambient air to be drawn into the duct enclosure 96 and venturi tube assembly 40, as needed, and to allow any excess air being supplied through transfer duct 92 to be exhausted downwardly through opening 96*a*. As shown in FIGS. 5, 6 and 7, the transfer duct 92 loosely fits into both the duct 80 and the duct enclosure 96 and allows air to escape therebetween because the ducting arrangement is not intended to provide a high pressure air flow from fan 82 to the venturi tube assembly 40 but rather merely a continuous air flow of a positive pressure slightly above atmospheric pressure for ensuring a continuously adequate supply of combustion air to the venturi tube assembly 40. In this manner the combustion of the gas/air mixture along the bottom surface of the ceramic radiants 36 is complete and continuously maintained, even through unusual openings and closings of the oven door 24 to greatly inhibit any possible flame roll-out. Further, such continuous supply of combustion air at a positive pressure through the venturi tube assembly 40 greatly inhibits any possible flash-back by cooling the venturi tube assembly during off-cycling of the gas/air mixture burning and encouraging the flame to remain below the ceramic radiants 36 rather than migrating upwardly therethrough into the plenum 50 and back through the venturi tube assembly 40 that may otherwise occur under unusual circumstances.

Referring now to FIGS. 8–13 illustrating another embodiment of the present invention, the kitchen range R is provided with the same or similar duct 80 on the back wall 20 with a fan 82 for drawing air through the space 84 at the top of the range and discharging that air through the opening 90 at the bottom of duct 80. The venturi tube assembly 40 is provided in the same or a similar location as described with respect to the first embodiment and has an opening 48 through the back wall 20. In this embodiment, a rectangular or other shaped opening 100 is provided in the rear wall of duct 80, rather than the opening 94 provided in the side of duct 80 in the first embodiment. A transfer duct 102 has an opening 104 at one end that substantially matches the opening 100 in the duct 80 with the transfer duct 102 mounted on the back wall 20 of the range R by, for example, flanges 106 and 108. Flange 106 includes an opening 106*a* for accommodating the gas supply line 49 (see FIG. 5) to the venturi tube assembly 40 without disconnecting the gas supply line. The transfer duct 102 has a central portion 102*a* of a rectangular box shape that extends from the opening 104 to a closed end 102*b* for conducting air from duct 80 laterally toward a location opposite the venturi tube assembly 40. The duct 102 is provided with an opening in the form of a vertical slot 102*c* adjacent the closed end 102*b* that faces inwardly toward the rear wall 20 at the location of the venturi tube assembly 40 and rear opening 48 thereof for discharging air from transfer duct 102 directly toward the venturi tube assembly 40. The slot 102*c* may be of any convenient shape and it should be noted that in this embodiment the slot 102*c* is spaced a distance from the opening 48, namely, the horizontal width of the flange 106, whereby an excessive pressure of air is not imposed upon the venturi tube assembly 40 from the transfer duct 102. By providing a moderate supply of air directly from slot 102*c* of transfer duct 102 directly at the transfer tube assembly 40, a positive supply of air is provided to the venturi tube assembly 40 without excessively pressurizing the venturi tube assembly and allowing for any excess air from slot 102*c* to be dispersed along back wall 20. Also, as with the opening 96*a* in the duct enclosure 96 of the first embodiment, the open space between the back wall 20 and duct 102 allows ambient air to be drawn into the venturi tube assembly 40 even if, for example, the fan 82 is not operating. Thus, with either of the specific embodiments shown in the drawings and described herein, although alternate embodiments will readily appear to those skilled in the art, such as, for example, providing a separate fan for supplying a positive air flow to the venturi tube assembly rather than using fan 82, a positive air flow is provided that inhibits potential problems in the operation of the infrared gas broiler 34.

Although it is not a part of the present invention, it should be noted that the oven 10 may also be provided with a conventional convection oven assembly, generally designated 70, on the rear wall 20 without adversely affecting the operation of the infrared gas broiler 34 or the positive air flow apparatus of the present invention. The convection oven assembly 70 includes a fan 71 driven by an electric motor 72 and may be surrounded by a heating element 73 for drawing air from the interior of the oven through a metal screen filter 74 mounted in the front of an enclosure 75 and discharging that air back into the oven from the right and left ends of the enclosure 75, as shown by arrows C in FIG. 4. Normally, the convection oven assembly 70 would be selectively operable when the oven is being used for baking with the bottom burner 26 (or a comparable electric heating element) energized but it may also be desirable to activate the convection oven assembly 70 during some food broiling operations when the infrared gas broiler 34 is activated. The positive air flow apparatus of the present invention for supplying air to the venturi tube assembly 40 does not adversely affect the operation of this convection oven assembly 70.

While specific embodiments of the present invention have been described in detail above, it is to be understood that various modifications, substitutions and additions may be made without departing from the spirit and scope of the present invention.

We claim:

1. In a kitchen oven having an infrared gas broiler with a venturi tube assembly extending forwardly from a back wall of the oven for supplying fuel gas and drawing ambient air for combustion through a venturi tube opening at the oven back wall, an improvement comprising:

ducting mounted on the oven back wall and extending over the venturi tube opening, and a fan mounted on the oven in communication with said ducting for supplying a positive air flow through the ducting to the venturi tube opening;

wherein said ducting includes a downwardly extending duct on the oven back wall and a laterally extending transfer duct having a first end communicating with said downwardly extending duct, said transfer duct having a second end communicating with the venturi tube opening.

2. The kitchen oven improvement of claim 1, wherein said ducting includes a duct enclosure at least partially surrounding the venturi tube opening and communicating with said second end of said transfer duct for receiving the positive air flow.

3. The kitchen oven improvement of claim 2, wherein said duct enclosure has closed sides and top with an open bottom.

4. The kitchen oven improvement of claim 3, wherein said transfer duct has an upwardly facing L-shaped portion on said second end extending into said duct enclosure.

5. The kitchen oven improvement of claim 1, 2, 3 or 4, wherein said transfer duct has an upwardly facing L-shaped portion on said first end extending into said downwardly extending duct.

6. The kitchen oven improvement of claim 1, wherein said first end of said transfer duct is mounted on a rear surface of said downwardly extending duct and an opening is provided between said transfer duct and said downwardly extending duct.

7. The kitchen oven improvement of claim 1 or 6, wherein said second end of said transfer duct is spaced rearwardly from the oven back wall and includes an opening opposite the venturi tube opening for discharging the positive air flow toward the venturi tube opening.

8. A kitchen oven comprising, an oven cell having a too wall, a bottom wall, side walls, a back wall and a front door, said oven cell having a heating means near the bottom wall for baking and an infrared gas broiler near the too wall for broiling, said infrared gas broiler having a venturi tube assembly extending forwardly from said back wall of the oven for supplying fuel gas and drawing ambient air for combustion through a venturi tube opening at said oven back wall, ducting on said oven back wall and extending over said venturi tube opening, and a fan mounted on the oven in communication with said venturi tube opening for supplying a positive flow of air to said venturi tube opening, said ducting having a free flow opening adjacent said venturi tube opening for allowing a free flow of ambient air into said venturi tube opening separate from said positive air flow supply and allowing a discharge of excess air of said positive air flow supply, wherein said ducting includes a downwardly extending duct on the oven back wall and a laterally extending transfer duct having a first end communicating with said downwardly extending duct, said transfer duct having a second end communicating with the venturi tube opening.

9. The kitchen oven of claim 8, wherein an inlet to said ducting is located adjacent said top wall for drawing ambient air over said top wall of the oven.

10. The kitchen oven of claim 9 or 8, wherein said ducting includes a duct enclosure at least partially surrounding the venturi tube opening and communicating with said second end of said transfer duct for receiving the positive air flow.

11. The kitchen oven of claim 10, wherein said duct enclosure has closed sides and top with an open bottom.

12. The kitchen oven of claim 9 or 8, wherein said first end of said transfer duct is mounted on a rear surface of said downwardly extending duct and an opening is provided between said transfer duct and said downwardly extending duct.

13. The kitchen oven of claim 9 or 8, wherein said second end of said transfer duct is spaced rearwardly from the oven back wall and includes an opening opposite the venturi tube opening for discharging the positive air flow toward the venturi tube opening, said free-flow opening being formed by the space between said oven back wall and said transfer duct.

14. The kitchen oven of claim 12, wherein said second end of said transfer duct is spaced rearwardly from the oven back wall and includes an opening opposite the venturi tube opening for discharging the positive air flow toward the venturi tube opening, said free-flow opening being formed by the space between said oven back wall and said transfer duct.

* * * * *